US012599805B2

(12) United States Patent
Fleck

(10) Patent No.: US 12,599,805 B2
(45) Date of Patent: Apr. 14, 2026

(54) BARBELL WEIGHTS

(71) Applicant: Weight It Out LLC, Plainfield, IL (US)

(72) Inventor: Brian Fleck, Plainfield, IL (US)

(73) Assignee: Brian Fleck, Plainfield, IL (US)

( * ) Notice: Subject to any disclaimer, the term of this patent is extended or adjusted under 35 U.S.C. 154(b) by 400 days.

(21) Appl. No.: 18/460,511

(22) Filed: Sep. 1, 2023

(65) Prior Publication Data

US 2024/0075334 A1 Mar. 7, 2024

Related U.S. Application Data

(60) Provisional application No. 63/374,619, filed on Sep. 6, 2022.

(51) Int. Cl.
*A63B 21/072* (2006.01)
*A63B 21/06* (2006.01)

(52) U.S. Cl.
CPC ..... *A63B 21/0724* (2013.01); *A63B 21/0604* (2013.01); *A63B 2209/00* (2013.01)

(58) Field of Classification Search
CPC ..... A63B 21/0604; A63B 21/0724; A63B 2071/0694; A63B 2209/00
See application file for complete search history.

(56) References Cited

U.S. PATENT DOCUMENTS 5,137,502 A * 8/1992 Anastasi ..... A63B 21/072 482/106
5,853,355 A * 12/1998 Standish ..... A63B 21/0601 482/106
6,319,176 B1 * 11/2001 Landfair ..... A63B 21/4017 482/106
6,436,015 B1 * 8/2002 Frasco ..... A63B 21/072 482/106
6,746,380 B2 * 6/2004 Lien ..... A63B 21/06 482/106
6,991,590 B2 * 1/2006 Vigiano ..... A63B 21/072 482/106
7,207,929 B2 * 4/2007 Hamilton ..... A63B 21/072 482/106
7,517,305 B2 * 4/2009 Lien ..... A63B 21/0728 482/106
9,283,423 B2 * 3/2016 Dickerson ..... A63B 21/0615
10,046,594 B1 * 8/2018 Ferry ..... B32B 27/36
10,232,215 B2 * 3/2019 Dickerson ..... A63B 21/0602
(Continued)

*Primary Examiner* — Joshua Lee
(74) *Attorney, Agent, or Firm* — Miller IP Law; Devin Miller

(57) ABSTRACT

Described herein are examples of barbell weights which include a first surface having a circular shape defined by a diameter and a circumference. The weights include a second surface having the circular shape and positioned approximately parallel to the first surface. The weights include an exterior circumference edge extending between the first surface and the second surface around the circumference. The exterior circumference edge defines a width between the first surface and the second surface. The weights include a central axis aperture having an interior circumference edge extending from the first surface to the second surface. The weights include one or more grip apertures having an interior grip aperture edge extending from the first surface to the second surface.

20 Claims, 5 Drawing Sheets

(56) References Cited

U.S. PATENT DOCUMENTS

| | | | | |
|---|---|---|---|---|
| 11,097,147 | B2 * | 8/2021 | Jones | A63B 21/0607 |
| 11,191,992 | B1 * | 12/2021 | Grace | A63B 21/072 |
| 11,376,464 | B2 * | 7/2022 | Bowers | A63B 21/0728 |
| 11,638,856 | B1 * | 5/2023 | Peal | A63B 21/225<br>482/5 |
| 2001/0049324 | A1 * | 12/2001 | Wallace | A63B 21/0783<br>482/106 |
| 2004/0092370 | A1 * | 5/2004 | Lincir | A63B 21/072<br>482/93 |
| 2005/0054496 | A1 * | 3/2005 | Harms | B44C 1/17<br>482/106 |
| 2006/0003874 | A1 * | 1/2006 | Hamilton | A63B 21/06<br>482/93 |
| 2006/0075910 | A1 * | 4/2006 | Cao | B41M 7/0027<br>101/129 |
| 2007/0184943 | A1 * | 8/2007 | Davies | A63B 21/0724<br>482/93 |
| 2007/0197352 | A1 * | 8/2007 | Charniga | A63B 21/06<br>482/93 |
| 2012/0165166 | A1 * | 6/2012 | Dickerson | A63B 21/0615<br>482/106 |
| 2020/0360755 | A1 * | 11/2020 | Rothschild | A63B 21/0607 |
| 2020/0384307 | A1 * | 12/2020 | Bowers | A63B 21/0728 |
| 2023/0271048 | A1 * | 8/2023 | Dao | A63B 21/065<br>482/92 |

* cited by examiner

Sand Shot

Molding Chamber Closed

Sand Squeezing

Mold Close-Up

Mold Push-Out

Mold String Transport Forward

BARBELL WEIGHTS

CROSS-REFERENCE TO RELATED APPLICATIONS

The present application claims the benefit of U.S. Provisional Patent Application No. 63/374,619 entitled "BARBELL WEIGHTS", filed on Sep. 6, 2022. The entire contents of the above-listed application are hereby incorporated by reference for all purposes.

BACKGROUND

Weights may have been used for exercise purposes for hundreds, if not, thousands of years. Weights provide added resistance to any human motion, thereby increasing the force and energy required to conduct the motion. The increased force and energy provide a higher-intensity workout. In the modern era, weights may have been standardized to allow individuals to understand exactly how much additional resistance is being added to any exercise. Weights for exercise purposes come in many forms, including barbell weights (plates), kettledrums, sandbells, medicine balls, dumbbells, an so forth. Various materials and combinations of materials can be used to prepare exercise weights. Additionally, exercise weights can be prepared in various shapes and sizes.

BRIEF DESCRIPTION OF THE DRAWINGS

The present description will be understood more fully when viewed in conjunction with the accompanying drawings of various examples of barbell weights. The description is not meant to limit the barbell weights to the specific examples. Rather, the specific examples depicted and described are provided for explanation and understanding of barbell weights. Throughout the description the drawings may be referred to as drawings, figures, and/or FIGS.

DETAILED DESCRIPTION

Figure 2:
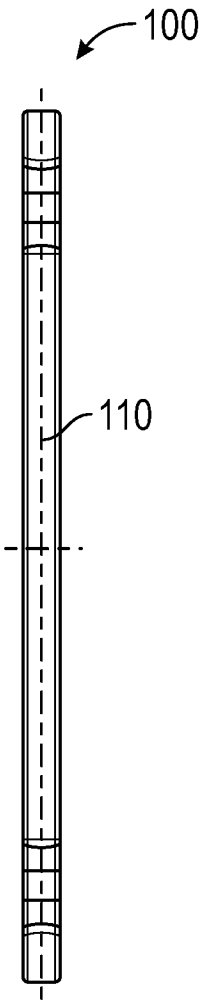
FIG. 2 illustrates a side view of a barbell weight, according to an embodiment.

A barbell weight as disclosed herein will become better understood through a review of the following detailed description in conjunction with the figures. The detailed description and figures provide merely examples of the various embodiments of barbell weights. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional barbell weight is generally constructed in a thin cylindrical shape. The cylindrical shaped barbell has a diameter that is greater than the width. Barbell weights are available in "Standard" and "Olympic" sizes. Standard barbell weights may have a 1-inch (25.4 mm) central axis hole or aperture, and Olympic barbell weights may have a 2-inch (50.8 mm) central axis hole or aperture. The central axis aperture is configured to accommodate a 1 inch (or 25 mm diameter sleeve of a Standard barbell), or a 2 inch (or 50 mm diameter sleeve of an Olympic barbell). The sleeve is the portion of the barbell configured to accept the barbell weights. A sleeve on an Olympic barbell is generally 415 mm in length. The central axis aperture is configured to be at the center of the barbell weight so that the weight will be evenly balanced when placed on a barbell. Olympic 45 lbs. or 20.4 kg barbell weights may have a set diameter of 450 mm, however, the width of the Olympic 45 lbs. barbell weight is not standardized.

Barbell weights can be prepared using various materials, and while generally cylindrical can be prepared with various patterns, concavities, convexities, ridges, lips, grip areas, and/or apertures. Many barbell weights may be designed to have prominent raised lips at the exterior circumference of the barbell weight. These raised lips aid the gripping of the barbell weight by human hands, allowing placing of the barbell weights (or plates) on the barbell sleeve, or for moving the barbell weights to storage. Additional patterns are used on barbell weights for aesthetic reasons or to improve the stacking of barbell weights either on the barbell or on racks/poles used for storage. Further, barbell weights can include large apertures, or holes located away from the center axis hole, that allow users to grip the barbell weight. These grip holes or grip aperture features are used for ease of movement, or to allow the barbell weight to be used for exercise without a barbell. Barbell weights with these types of large apertures are often known as grip plates.

Barbell weights with raised lips, patterns, and large apertures, but standardized weight and diameter, result in barbells with increased widths (or height if you are measuring the cylinder in a horizontal position). Additionally, depending on the density of the material employed to make the barbell weight, for example, sand-filled plastic, solid plastic, urethane, cast iron, or stainless-steel, the width of the barbell weight can further vary.

Implementations of barbell weights with a uniform width and high density will provide optimization of the width of the barbell. For a standardized barbell weight, such as a 45 lbs. Olympic barbell weight, which must be 450 mm in diameter, an embodiment of the barbell weight can be prepared from stainless steel with a 2-inch central axis hole, two grip apertures with an area of approximately 6.3 square inches, and with a width of less than 1 inch. Conventional 45 lbs. Olympic barbell weight barbell weights may have widths ranging from 2 to 5 inches, 1 to 4 inches, 3 to 6 inches, and so forth. This reduction in width for standardized barbell weights provides the ability to place more barbell weights on the sleeve of a barbell, reduces the required storage space, and provides an aesthetically pleasing streamlined appearance.

Figure 1:
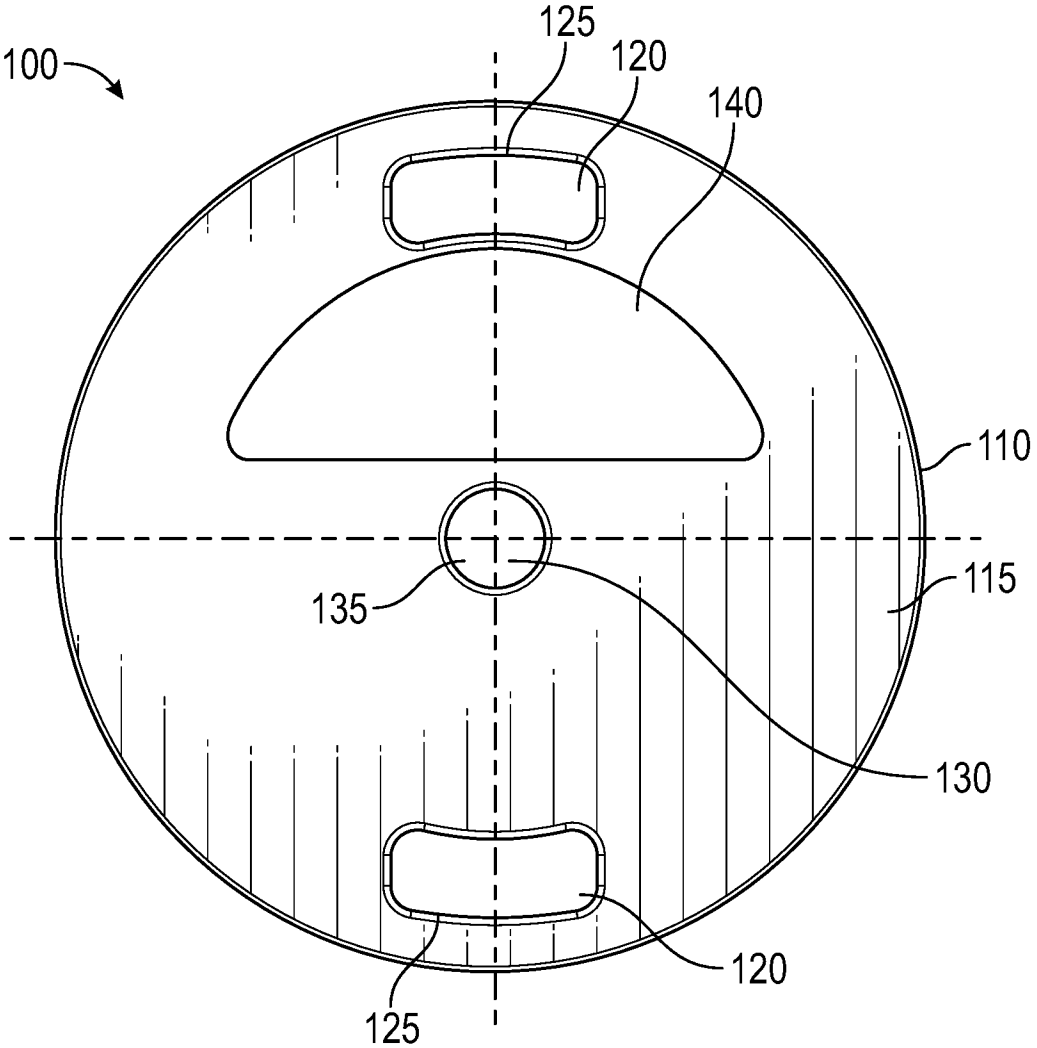
FIG. 1 illustrates a front view of a barbell weight, according to an embodiment.

FIG. 1 illustrates a barbell weight 100, according to an embodiment. The barbell weight 100 includes an exterior circumference edge 110, a central axis aperture 130, and grip apertures 120. The central axis aperture 130 is defined by an interior circumference edge 135. The grip apertures 120 are defined by an interior grip aperture edge 125. The barbell weight 100 further includes a personalization space 140.

The barbell weight 100 is formed having a cylindrical shape with a diameter that is greater than the width of the cylinder (the width can also be referred to as the height of the cylinder when the barbell weight is in a horizontal position). The barbell weight 100, further includes two flat surfaces, a first barbell weight surface 115 and an opposite second barbell weight surface 117, with the exterior circumference edge 110 completing the total surface area of the barbell weight 100. The width of the barbell weight corresponds to the linear distance from the first barbell weight surface 115 to the second barbell weight surface 117 across the exterior circumference edge 110. When surface area is referred to, it is referencing either the first barbell weight surface 115, the second barbell weight surface 117, or both barbell weight surfaces, 115, 117.

Embodiments of the barbell may have a diameter that is between 5 to 100 times larger than the width, 10-50 times larger than the width, 15-30 times larger than the width, or 20-25 times larger than the width. In one embodiment, the diameter of the barbell is 450 mm and the width of the barbell weight is 19.56 mm, which is a diameter 23 times larger than the width.

An embodiment of the barbell weight 100 has a uniform width. That is, the linear distance between the first barbell weight surface 115 to the second barbell weight surface 117, normal to both surfaces (perpendicular), may be approximately equal for different points of the first barbell weight surface 115 to the second barbell weight surface 117. As used herein the term uniform width does not reflect apertures in the barbell weight 100, therefore an aperture, as defined herein, passes completely through the barbell weight 100, from a first barbell weight surface 115 to the second barbell weight surface 117, such an aperture does not affect the uniform width of the barbell weight 100. Additionally, minor indentations in the surface area of the barbell weight 100, such as writing pressed or cut into the surface of the barbell weight, does not affect the uniform nature of the barbell weight 100. Variations in the uniform width of the barbell weight 100, such as concavities, convexities, ridges, patterns, or designs in the surface of the barbell weight 100 greater or less than 5 mm from absolute uniformity result in a non-uniform width.

The barbell weight 100 includes a central axis aperture 130 located in the center of the barbell weight 100. The centralized location of the central axis aperture 130 allows for the weight of the barbell weight 100 to be evenly distrusted when the barbell weight 100 is placed on a barbell or a storage device 150. The central axis aperture 130 may have a diameter between approximately 0.5 and approximately 3.0 inches, between approximately 1.0 and approximately 2.0 inches, or between approximately 1.0 inch or approximately 2.0 inches. To accommodate a 1-inch Standard sleeve or a 2-inch Olympic sleeve, the central axis aperture 130, while defined as approximately 1.0 or approximately 2.0 inches in diameter is often 5% larger The grip apertures 120 are located in the barbell weight 100 between the central axis aperture 130 and the exterior circumference edge 110. In embodiments of the barbell weight 100 there may be one grip aperture 120. Embodiments can include two grip apertures 120 positioned or located an equal distance from the central axis aperture 130. Alternate embodiments can include between 1 and 10 grip apertures 120. In another embodiment, there are an even number of grip apertures 120, and sets of grip apertures 120 are located equidistant from the central axis aperture 130 to provide stability to the barbell weight 100. Barbell weights 100 can be made without any grip apertures 120. Embodiments for weights of less than 45 lbs., for example, 25 lbs., 10 lbs., 5 lbs., 2.5 lbs. and 1 lbs. can be lifted and moved by average humans without the need for a grip aperture 120. Embodiments without a grip aperture 120 may have a reduced width compared to embodiments with grip apertures 120.

The area of the grip aperture 120 can vary depending on the desired size and weight of the barbell weight 100. In one embodiment, for a 45 lbs. or 20.4 kg barbell weight, there are two grip apertures 120 in which the area of the grip aperture 120 is between approximately 3.0 and approximately 10.0 square inches, between approximately 5.0 and approximately 8.0 square inches, or between approximately 6.0 and 7.0 square inches. Embodiments of barbell weight 100 include the grip aperture 120 located within approximately 1.0 to approximately 3.0 inches of the exterior circumference edge 110 to accommodate the size of the average human hand. In one embodiment, the grip aperture 120 can be located less than approximately 2.0 inches from the exterior circumference edge 110, or less than approximately 1.0 inch from the exterior circumference edge 110. The grip aperture 120 is designed to be greater in length than height (distances being described for barbell weight 100 in the upright vertical position), and located close to the exterior circumference edge 110 to accommodate a human hand gripping the barbell weight 100.

In embodiments where the grip aperture 120 is in the shape of a curved rectangle with rounded edges as illustrated in FIG. 1, the grip aperture 120 has a length between approximately 1.0 to approximately 10.0 inches, between approximately 2.0 to approximately 8.0 inches, or between approximately 3.0 to approximately 6.0 inches; and a height between approximately 0.1 to approximately 5.0 inches, between approximately 0.5 to approximately 3.0 inches, or between approximately 1.0 to approximately 2.0 inches.

Embodiments of the barbell weight 100 can be prepared for weights ranging from approximately 100.0 lbs. to approximately 0.5 lbs., for example, 45 lbs., 25 lbs., 10 lbs., 5 lbs., 2.5 lbs. and 1 lbs. Embodiments of the barbell weight 100 can be prepared for weights using standard metric weights in whole kilogram variations as well. The diameter and width of the barbell weight 100 can be varied to accommodate different weights of the barbell weight 100. Embodiments of different weights for the barbell weight 100 will include uniform width, with and without grip apertures 120, resulting in an optimized width of the barbell weight 100. This results in ascetically pleasing streamlined weights that take up less storage space and allow for more barbell weights 100 to be placed on a barbell sleeve.

The width of the barbell weight 100 can be further optimized by employing higher-density materials to prepare or manufacture the barbell weight 100. Embodiments are prepared from pig iron, cast iron, stainless steel, titanium, and so forth. By increasing the density of the metal employed for the barbell weight 100, the width can be reduced and/or additional or larger grip apertures 120 can be included.

FIG. 1 illustrates a barbell weight 100, with a personalization space 140, in an embodiment. The personalization space 140 can be any shape suitable for the available surface area of the barbell weight 100. Embodiments of the barbell weight 100 can include a generally triangular personalization space 140 as illustrated in FIG. 1, which can contain writing, symbols, graphics, designs, or other personalized features. This can include a person's name, the name of a gym, the name of a competition, or images, logos, or design features chosen to personalize the barbell weight 100. The personalization space can be a depressed area of the barbell weight surface 115, 117. To maintain the uniform width of the barbell weight 100, the defining edges of the personalization space 140, if any, are less than approximately 5 mm in height. A flat removable component can be fixed into the personalization space 140. The flat removable component can be made permeant by use of adhesives, compression, or other techniques, or it can be removable and exchangeable. The features in the personalization space 140 can be applied to the barbell weight after manufacturing the barbell weight 100, such as by paint, stickers, laser engraving, or the features can be pressed into the barbell weight 100 during manufacturing/molding.

FIG. 2 illustrates a side view of the barbell weight 100 in a vertical upright position, in an embodiment. The exterior circumference edge 110 is shown. This is also the width of the barbell weight 100. Embodiments of a barbell weight 100 may have an exterior circumference edge 110 with a width between approximately 0.1 and approximately 3.0 inches, approximately 0.25 and approximately 2.0 inches, or between approximately 0.4 and approximately 1.0 inch. An embodiment of an Olympic barbell weight 100 for a 45 lbs. or 20.4 kg weight prepared from stainless steel, with two grip apertures 120, has a width of less than approximately 1.0 inch or approximately 0.77 inches. Embodiments of the barbell weight 100 can include various size grip apertures 120, which may have an effect on the final width.

Embodiments of the barbell weight 100 in various weights may have different diameters, widths, number of grip apertures 120, as well as sizes and shapes of the grip apertures 120.

Figure 3:
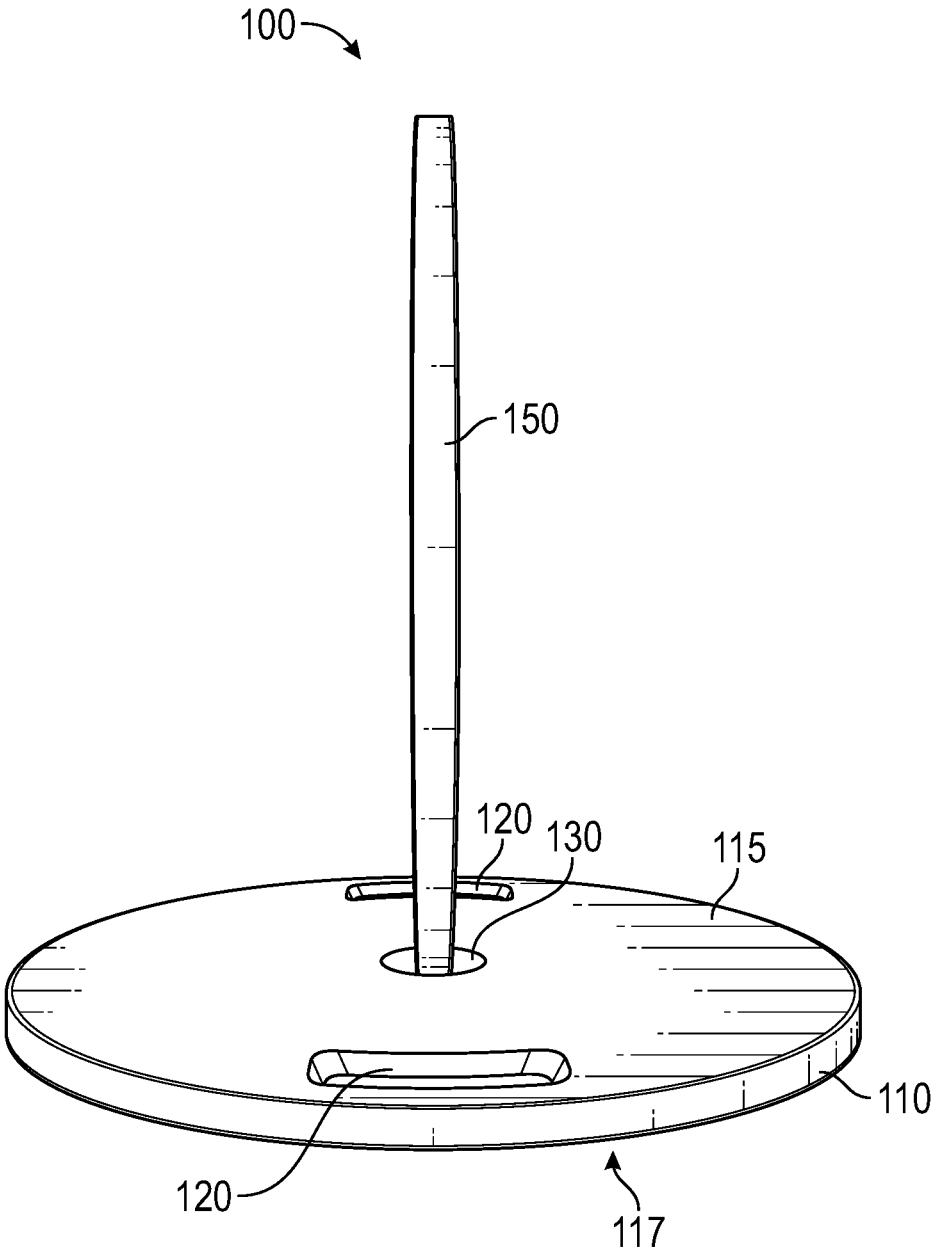
FIG. 3 illustrates a perspective view of a barbell weight on a vertical storage pole, according to an embodiment.

FIG. 3 illustrates a perspective view of the barbell weight 100 in a horizonal storage position, in an embodiment. The barbell weight 100 in the embodiment is placed on a storage device 150. The barbell weight 100 may be placed on the storage device 150 by aligning the central axis aperture 130 with the storage device 150. The storage device 150 can be any type of storage device commonly used for weights. In embodiments, the storage device 150 may be rectangular or cylindrical and has a maximum width or diameter that is less than the diameter of the central axis aperture 130

Figure 4:
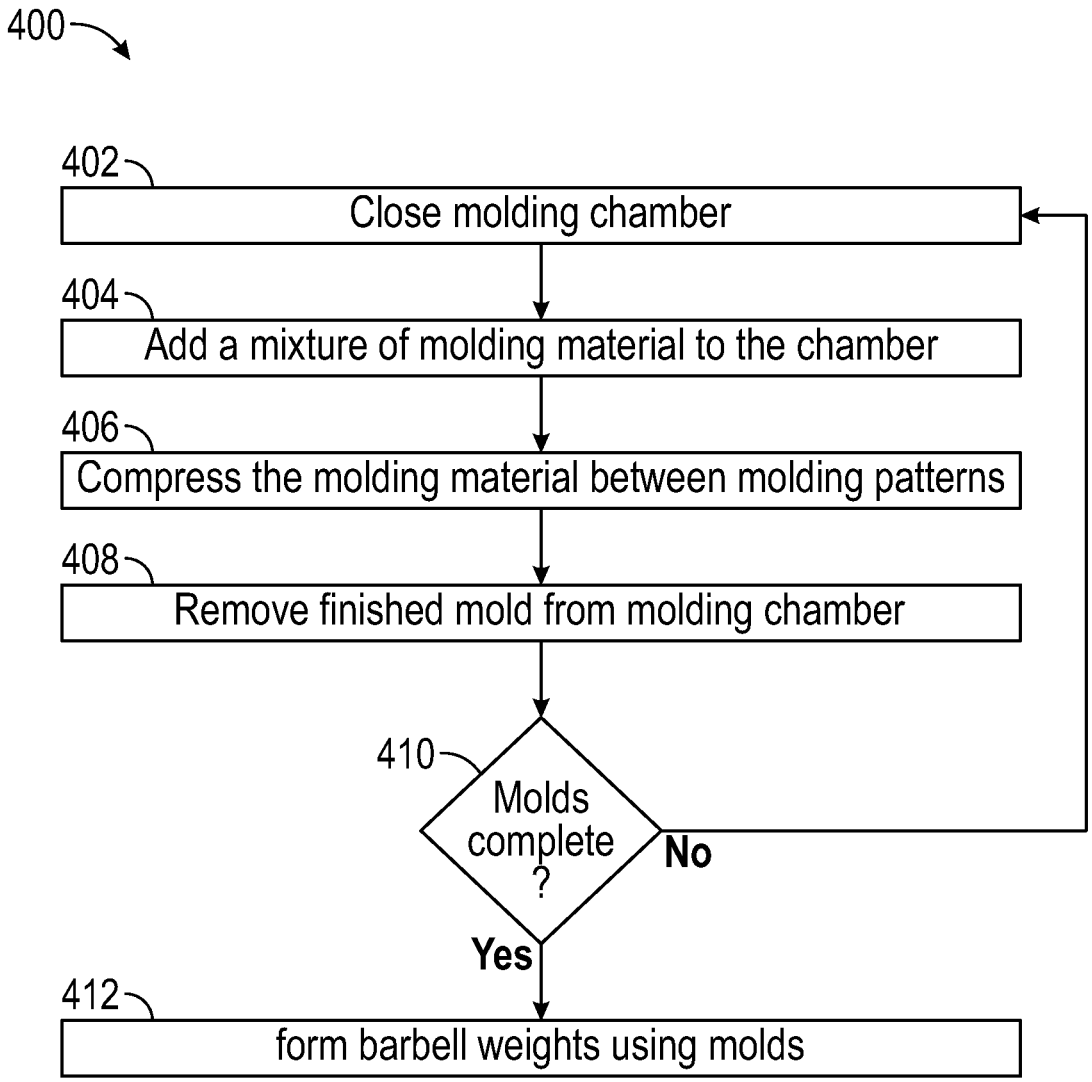
FIG. 4 illustrates a process for manufacturing barbell weights, according to an embodiment.

FIG. 4 illustrates a vertical molding process 400 for preparing the barbell weight, for example, barbell weight 100, of an embodiment. The vertical molding process 400 can be performed using any type of molding machine, apparatus, or system. FIG. 5A-5F illustrates a molding machine 410 and a mold transporting conveyor 420 that can be used to perform the vertical molding process 400.

Figure 5B:
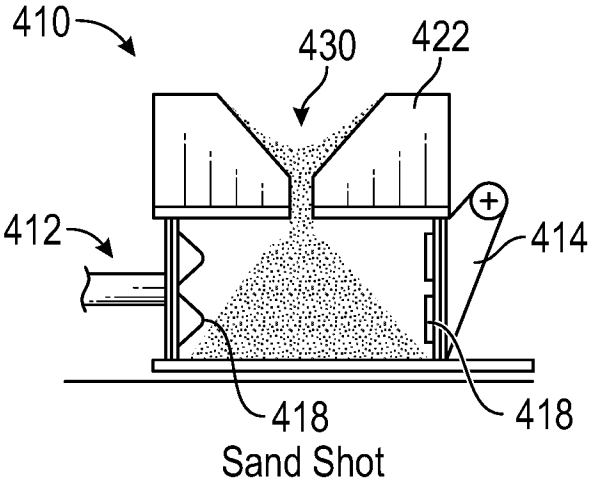
FIGS. 5A-5F illustrates molding machine and process for manufacturing barbell weights, according to an embodiment.
Figure 5A:
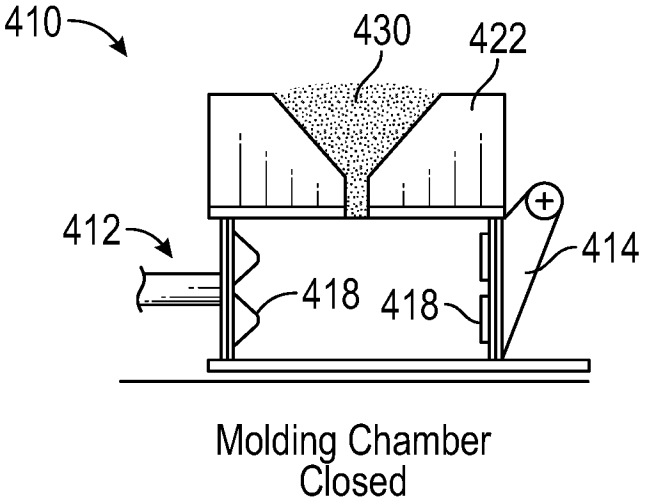

After the process 400 begins, in stage 402, the molding chamber is closed. For example, as illustrated in FIG. 5A, the molding machine 410 may include a downstream chamber plate 412, an upstream chamber plate 414, and mold patterns 418. In state 402, for example, the downstream chamber plate 412 and the upstream chamber plate 414 thereby creating a molding chamber including the mold patterns 418. The molding machine 410 can also include a material reservoir 422 holding a mixture of molding sand 430.

In stage 404, a mixture of molding material is added to the molding chamber. For example, as illustrated in FIG. 5B, a mixture of molding sand 430 is added to the molding machine 410. In embodiments, the molding sand 430 can include benzoate, green sand, and mixtures thereof. The molding sand 430 can be added to the molding machine 410 by standard techniques, such as using compressed air.

Figure 5C:
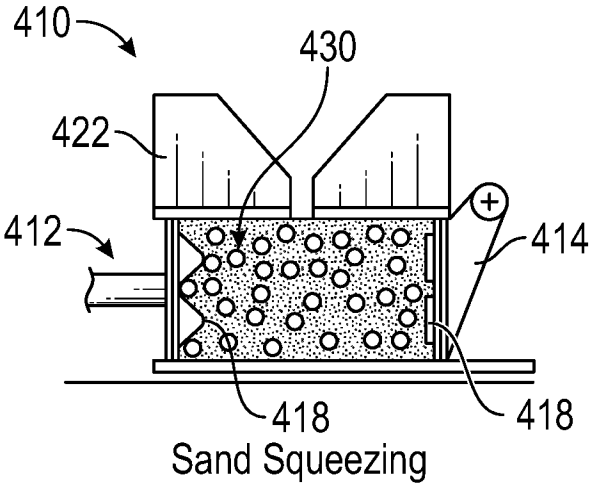

In stage 406, the molding material is compressed between molding patterns. For example, as illustrated in FIG. 5C, the molding sand 430 is then squeezed in the molding machine 410 between two mold patterns 418 located at opposite sides of the molding machine 410.

Figure 5E:
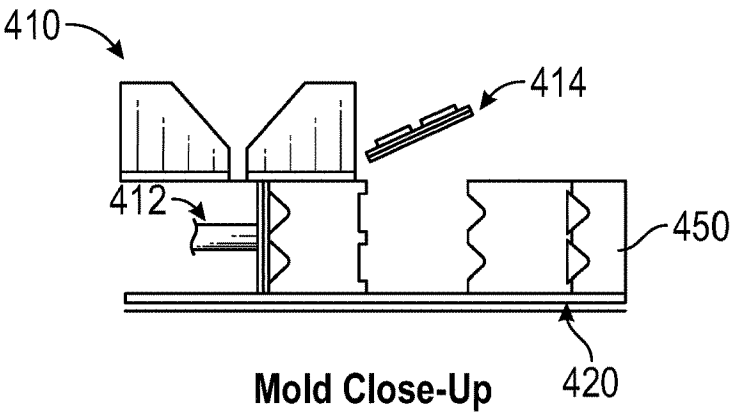
Figure 5D:
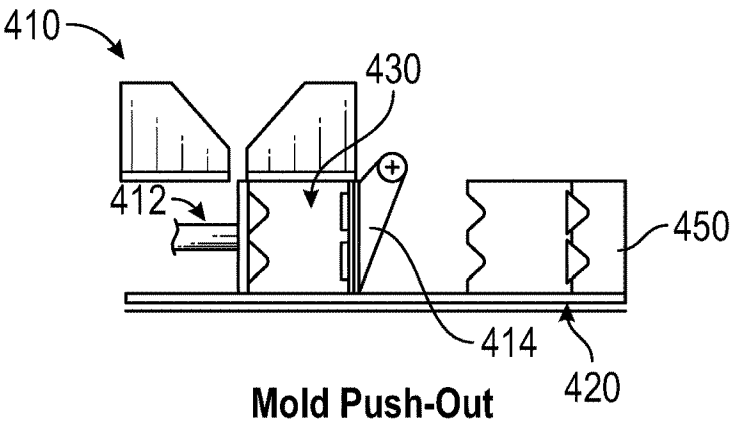

In stage 408, a finished mold is removed from the molding chamber. For example, as illustrated in FIGS. 5D and 5E, after squeezing, the upstream chamber plate 414 opens and the downstream chamber plate 412 pushes the finished mold 450 onto the mold transporting conveyor 420.

Figure 5F:
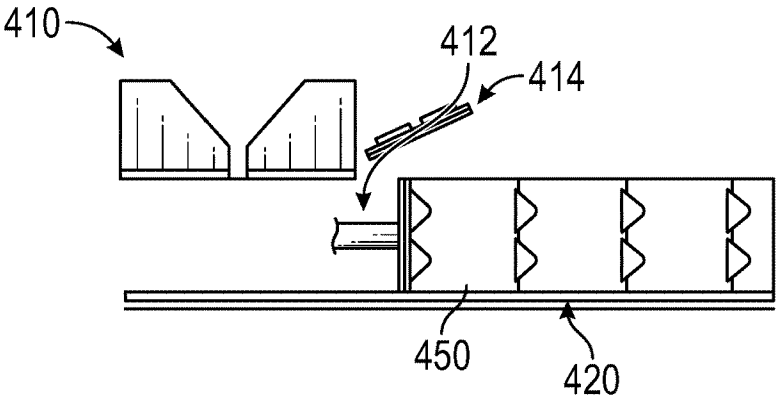

In stage 410, it is determined if all the finished molds are completed. If not, the process 400 returns to 402 and repeats. For example, as illustrated in FIG. 5F, the vertical molding process 400 continues until multiple finished molds 450 are placed in a row on the mold transporting conveyor 420.

In stage 412, barbell weights are formed using the finished molds. For example, the finished molds 450 are then filled with material to be used to prepare the barbell weights 100, for example stainless-steel or cast iron. In an embodiment, the finished molds are filled with Grade 30 gray iron, and placed on a cooling conveyor. Then the solidified barbell weights 100 are separated from the finished molds 450.

In an embodiment, after being removed from the finished molds 450, the barbell weight 100 are blasted with a hard-abrasive material, such as stainless-steel shot, to remove any contaminants and provide a uniform finish. The barbell weights 100 are then transferred to a finishing area where they are ground, by hand or by machines, to remove any flashing or residual components from the mold that may remain on the barbell weights 100, particularly along the exterior circumference edge 110, the interior circumference edge 135, and the interior grip aperture edge 125.

The barbell weights 100 are then transferred to a quality control station for inspection to ensure the casting meets the specifications.

Next the barbell weights 100 are coated. The coating can be a clear coat paint, acrylic paint, powder coating, electroplating, gold plating, steel plating, and so forth, or mixtures thereof.

The barbells can be imprinted using a press technique to apply writings or designs to the surface of the barbell weight 100. In an alternate embodiment writing and or designs are included in the mold patterns 418 used during the molding process.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples may have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not may have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub- combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A barbell weight comprising:

a first surface having a circular shape defined by a diameter and a circumference;

a second surface having the circular shape and positioned approximately parallel to the first surface;

an exterior circumference edge extending between the first surface and the second surface around the circumference, wherein the exterior circumference edge defines a width between the first surface and the second surface;

a central axis aperture having an interior circumference edge extending from the first surface to the second surface; and one or more grip apertures having an interior grip aperture edge extending from the first surface to the second surface, wherein the diameter is between 20 and 25 times the width, and the width is uniform around the circumference.

2. The barbell weight of claim 1, further comprising:

a personalization space formed with at least one of the first surface or the second surface.

3. The barbell weight of claim 2, wherein the personalization space comprises an alpha-numeric message that is removably coupled to the personalization space.

4. The barbell weight of claim 1, wherein:

the central axis aperture is positioned at approximately the center of the first surface and the second surface at equal distance from the exterior circumference edge; and the central axis aperture is between approximately 1.0 and approximately 2.0 inches in diameter.

5. The barbell weight of claim 1, wherein:

the one or more grip apertures are positioned equidistant from the central axis aperture; and the one or more grip apertures are positioned within approximately 1.0 to approximately 2.0 inches of the exterior circumference edge.

6. The barbell weight of claim 1, wherein:

the one or more grip apertures comprise a first grip aperture and a second grip aperture;

the first grip aperture and the second grip aperture are positioned equidistant from the central axis aperture; and the first grip aperture and the second grip aperture are positioned within approximately 1.0 to approximately 2.0 inches of the exterior circumference edge.

7. The barbell weight of claim 1, wherein:

the one or more grip apertures comprise an approximately square cross-section; and the square cross-section is between approximately 3.0 and 10.0 square inches in area.

8. The barbell weight of claim 1, wherein the barbell weight comprises one or more of pig iron, cast iron, stainless steel, or titanium.

9. The barbell weight of claim 1, wherein the central axis aperture is between approximately 1.0 and approximately 2.0 inches in diameter.

10. A method of manufacturing a weight, the method comprising:

forming a mold representing a structural shape of a weight, the structural shape comprising:

a first surface having a circular shape defined by a diameter and a circumference, a second surface having the circular shape and positioned approximately parallel to the first surface, an exterior circumference edge extending between the first surface and the second surface around the circumference, wherein the exterior circumference edge defines a width between the first surface and the second surface, a central axis aperture having an interior circumference edge extending from the first surface to the second surface, one or more grip apertures having an interior grip aperture edge extending from the first surface to the second surface, and a personalization space formed with at least one of the first surface or the second surface, wherein the diameter is between 20 and 25 times the width, and the width is uniform around the circumference;

injecting one or more materials into the mold to form the weight; and removing the weight from the mold.

11. The method of claim 9, wherein the one or more materials comprises one or more of pig iron, cast iron, stainless steel, or titanium.

12. The method of claim 9, the method further comprising:

after removing the weight from the mold, applying one or more coatings to the weight, the one or more coatings comprising clear coat paint, acrylic paint, powder coating, electroplating, gold plating, or steel plating.

13. The method of claim 9, the method further comprising:

after removing the weight from the mold, applying an abrasive material to the weight.

14. The method of claim 9, wherein forming the mold comprises:

inserting one or more mold forms into a molding chamber;

adding a mold material to the molding chamber;

compressing the mold material in the one or more mold forms to create the mold; and transporting the mold from the molding chamber.

15. The method of claim 13, wherein the molding material comprises a mixture of molding sand.

16. The method of claim 9, the method further comprising:

forming one or more alpha-numeric messages in the personalization space.

17. The method of claim 9, wherein:

the central axis aperture is positioned at approximately the center of the first surface and the second surface at equal distance from the exterior circumference edge; and the central axis aperture is between approximately 1.0 and approximately 2.0 inches in diameter.

18. The method of claim 9, wherein:

the one or more grip apertures are positioned equidistant from the central axis aperture; and the one or more grip apertures are positioned within approximately 1.0 to approximately 2.0 inches of the exterior circumference edge.

19. The method of claim 9, wherein:

the one or more grip apertures comprise a first grip aperture and a second grip aperture;

the first grip aperture and the second grip aperture are positioned equidistant from the central axis aperture; and the first grip aperture and the second grip aperture are positioned within approximately 1.0 to approximately 2.0 inches of the exterior circumference edge.

20. A device comprising:

a cylindrical barbell weight with a diameter, a circumference, and a width, wherein:

the diameter of the barbell weight is between 20 and 25 times the width of the barbell weight; and the width of the barbell weight is uniform;

an exterior circumference edge;

a central axis aperture defined by an interior circumference edge, wherein the central axis aperture is between 1 and 2 inches in diameter;

two grip apertures each defined by an interior grip aperture edge, wherein:

the two grip apertures are located equidistant from the central axis aperture and within 1 to 2 inches of the exterior circumference edge; and the grip apertures are between 3 and 10 square inches in area; and a personalization space.

* * * * *